US008075962B2

(12) United States Patent
Tran et al.

(10) Patent No.: US 8,075,962 B2
(45) Date of Patent: Dec. 13, 2011

(54) NEWSPRINT MEDIA FOR INKJET PRINTING

(75) Inventors: Hai Quang Tran, San Diego, CA (US); Kelly Ronk, San Diego, CA (US); Rodney Stramel, San Diego, CA (US); Xiaoqi (Charlie) Zhou, San Diego, CA (US); John L Stoffel, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1352 days.

(21) Appl. No.: 11/701,146

(22) Filed: Jan. 31, 2007

(65) Prior Publication Data

US 2008/0180502 A1 Jul. 31, 2008

(51) Int. Cl.
*B41M 5/00* (2006.01)

(52) U.S. Cl. ..... 428/32.21; 428/32.3; 427/243

(58) Field of Classification Search ..... 428/32.21, 428/32.3, 32.31

See application file for complete search history.

(56) References Cited

U.S. PATENT DOCUMENTS

| | | | | |
|---|---|---|---|---|
| 5,989,650 | A * | 11/1999 | Inamoto et al. | 427/487 |
| 6,099,625 | A | 8/2000 | Bradbury et al. | |
| 6,413,708 | B1 | 7/2002 | Slusarek et al. | |
| 6,531,271 | B1 | 3/2003 | Szajewski et al. | |
| 2003/0227531 | A1 * | 12/2003 | Hosoi et al. | 347/105 |

FOREIGN PATENT DOCUMENTS

| | | | |
|---|---|---|---|
| JP | 2003-326844 | | 11/2003 |
| JP | 2005028573 | A * | 2/2005 |
| WO | 9906219 | A1 | 2/1999 |

OTHER PUBLICATIONS

European Search Report for European Patent Application No. EP 08727539.2.

* cited by examiner

*Primary Examiner* — Betelhem Shewareged

(57) ABSTRACT

A newsprint medium for inkjet printing includes a newsprint medium base paper and a layer of multivalent salt disposed on at least one side of said base paper.

19 Claims, 8 Drawing Sheets

1100

NEWSPRINT MEDIA FOR INKJET PRINTING

BACKGROUND

Newsprint media generally have mechanical pulp and high lignin content. Because the paper stock used for newsprint undergoes less processing than in other forms of paper media, newsprint media are relatively inexpensive to manufacture and can be produced faster and more easily than other, more refined paper products. These characteristics often make newsprint media suitable and desirable for use in high volume, non-archival printing applications.

Inkjet printing is a popular approach to printing images and text on paper products. This type of printing involves the deposition of tiny droplets of liquid ink on the surface of a substrate.

The versatility and practical advantages of inkjet printing have thus far been generally unavailable to newsprint media applications due to the fact that typical inkjet inks are generally considered to be incompatible with today's common newsprint media. The liquid inkjet inks penetrate the thin newsprint media causing unacceptable strike through and low color gamut. The high pulp and lignin content of the newsprint media may also contribute to undesirable liquid ink blur. Furthermore, it has been observed that liquid ink has an increased dry time when used with untreated newsprint media than when used with other paper media, which may contribute to the smearing of printed images before the ink has dried.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

In some cases, it may be desirable to extend the benefits of inkjet printing into the use of newsprint media. While such a combination is feasible, liquid ink exhibits poor strikethrough, color gamut, optical density, and bleeding performance in images printed on paper products with relatively high amounts of mechanical pulp such as newsprint media.

To address the issue of improving the print quality of images created on newsprint by inkjet printers, the present specification describes exemplary newsprint media, methods, and systems for including a multivalent salt in newsprint media to increase the print quality of images printed by liquid ink on the media. The multivalent salt acts as a mordant to inkjet inks and limits colorant in the inks from penetrating into the paper. By keeping the colorant on the surface of the newsprint media, color gamut and optical density are significantly increased while dry time, strikethrough, and bleeding are significantly reduced.

As used in the present specification and in the appended claims, the term "multivalent salt" refers to an ionic compound comprising a cation having a chemical valence greater than one.

As used in the present specification and in the appended claims, the terms "newsprint" or "newsprint media" refer to print media traditionally used to produce newspapers and/or a paper comprising at least 60% mechanical pulp.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

The principles disclosed herein will now be discussed with respect to exemplary newsprint media, exemplary methods of fabricating newsprint media, exemplary printing systems, and exemplary data.

Exemplary Newsprint Media

Figure 1:
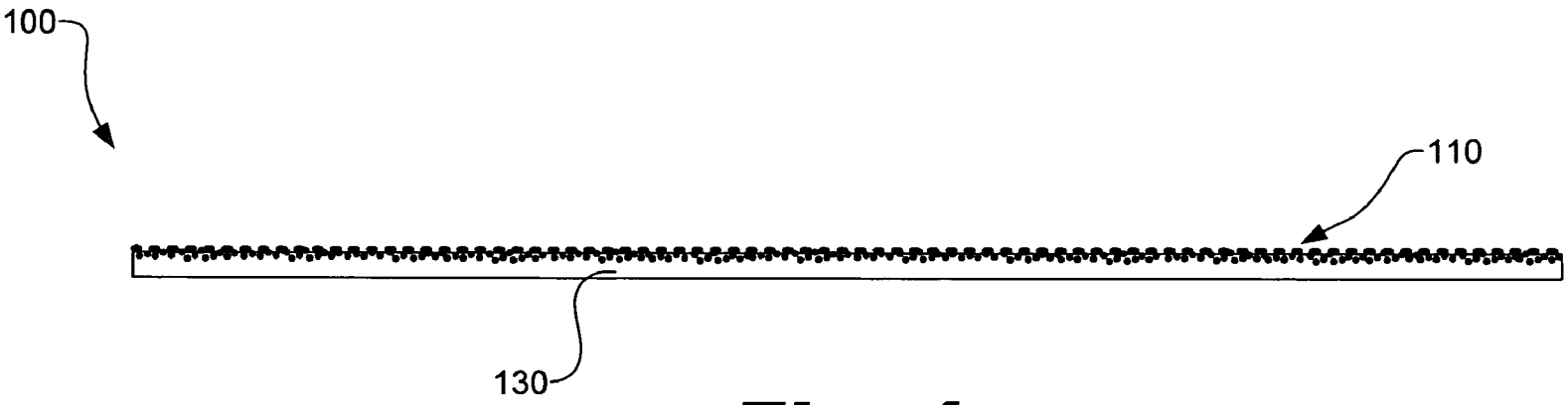
FIG. 1 is an illustration of an exemplary embodiment of a newsprint medium for inkjet printing according to principles described herein.

Referring now to FIG. 1, an exemplary newsprint medium (100) is illustrated. The exemplary newsprint medium (100) comprises a base paper (130) having a layer of multivalent salt (110) disposed on at least one side of the base paper (130). Being classified as a newsprint medium (100), the base paper (130) in this example comprises at least 60% mechanical pulp by weight.

The multivalent salt (110) may comprise, but is not limited to, calcium chloride, magnesium chloride, calcium nitrate, aluminum chloride, sulfates of di- and trivalent metals, nitrates of di- and trivalent metals, and combinations thereof.

The multivalent salt (110) may form a chemical bond and/or physical interaction with a colorant, such as a pigment or dye, present in a liquid inkjet ink deposited on the medium (100) by an inkjet printer or inkjet printing process. A chemical bond and/or physical interaction with the multivalent salt (110) may prevent the colorant from substantially penetrating the surface of the base paper (130) due to the fact that the multivalent salt (110) is present on the surface of the base paper (130). In some embodiments, the colorant in the ink may act as a chelating agent to the cation in the multivalent salt (110), thus anchoring the colorant particles to particles of the multivalent salt (110).

Figure 2:
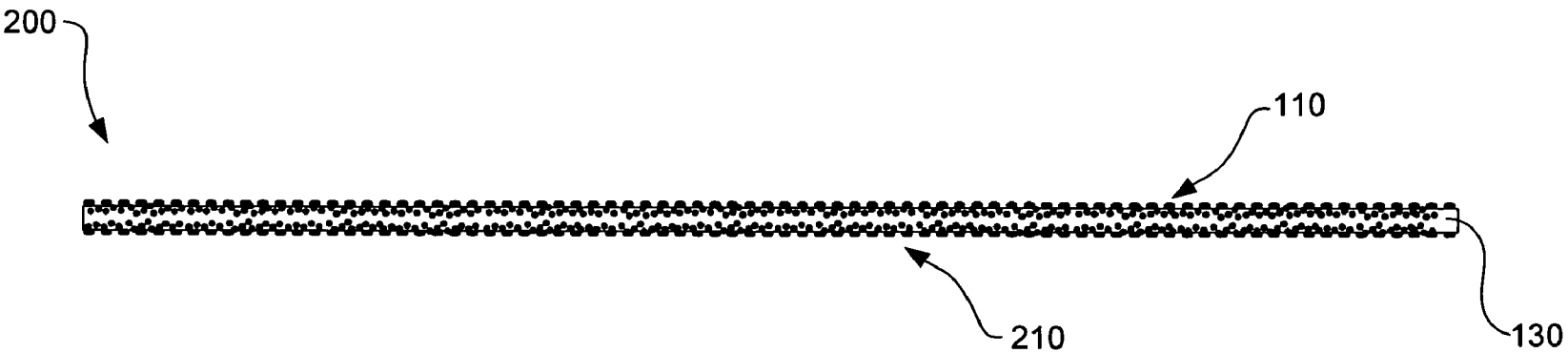
FIG. 2 is an illustration of an exemplary embodiment of a newsprint medium for inkjet printing according to principles described herein.

Referring now to FIG. 2, another exemplary newsprint medium (200) is shown. The medium (200) comprises a base paper (130) coated with a first layer of multivalent salt (110) on one side and a second layer of multivalent salt (210) on another side.

Due to the fact that many printing applications (e.g. newspaper printing) require printing images or text on both sides of the substrate, this exemplary newsprint medium (200) is specifically adapted for two-sided printing. By binding to the colorant particles in the liquid ink at the surface of the newsprint medium (200), the layers of multivalent salt (110) may decrease strikethrough from liquid ink printed on either side of the medium (200) and enhance the overall printed quality and feasibility of two-sided inkjet newsprint.

In some embodiments the layers of multivalent salt (110) may be deposited separately on each side of the newsprint medium (200). In other embodiments a multivalent salt solution that is spray coated on one side of the newsprint medium (200) may be absorbed through to the other side of the medium (200), thereby providing a layer of multivalent salt (110) on either side of the medium (200).

Exemplary Methods of Fabrication

The multivalent salt (110) may be deposited on a surface of the base paper (130) through a spray coating process. In this example, an aqueous solution, of which at least 3% is the multivalent salt, may be sprayed on the base paper (130) and allowed to dry. Upon drying, a layer of multivalent salt (110) will have become incorporated into the fiber network of the base paper (130).

Figure 3:
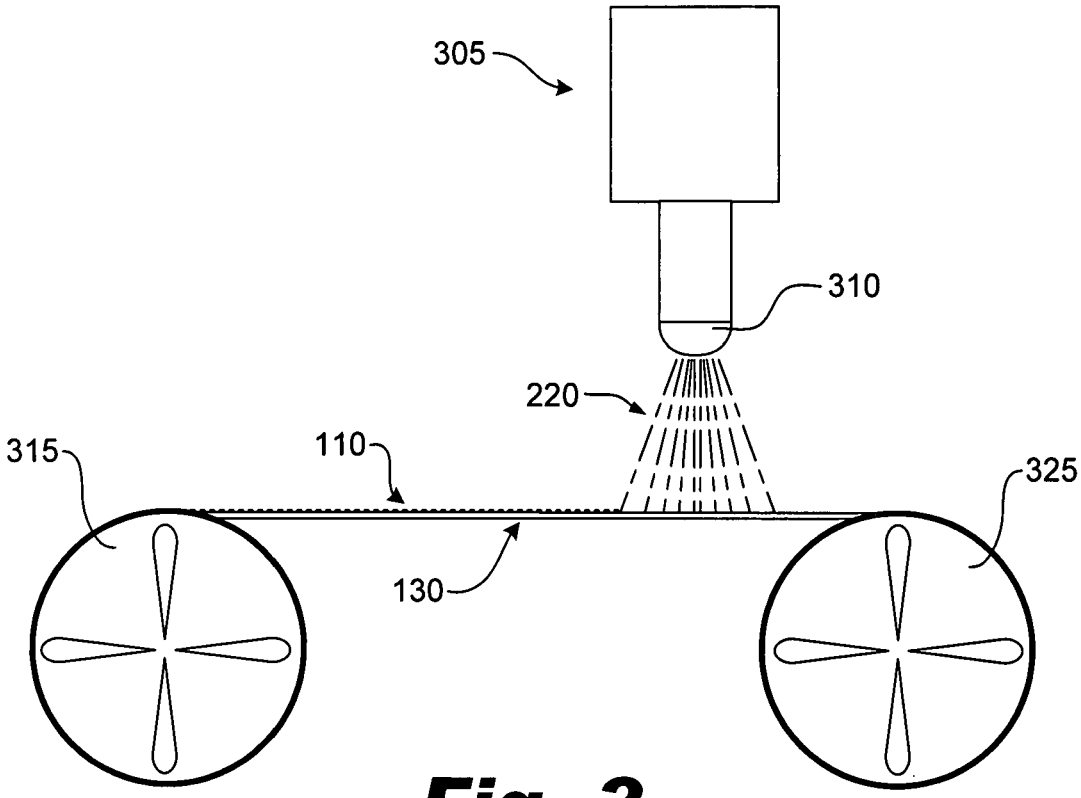
FIG. 3 is an illustration of an exemplary method of fabricating a newsprint medium for inkjet printing according to principles described herein.

A variety of spray coating methods may be used with the present embodiment. Referring now to FIG. 3, an exemplary spray coating apparatus (305) is shown applying a multivalent salt solution (220) to a base paper (130) to create a newsprint medium (100; FIG. 1) suitable for inkjet printing. The base paper (130) is passed under an adjustable spray nozzle (310) by, for example, transferring the base paper (130) from a first rotating spool (325) to a second rotating spool (315). The rate at which the spools (325, 315) rotate may be adjusted to pass the base paper (130) under the nozzle (310) at a desired speed.

The adjustable spray nozzle (310) may be configured to alter the rate at which the multivalent salt solution (220) is sprayed onto the base paper (130) and the area over which the solution (220) is sprayed. By adjusting factors such as the rate at which the base paper (130) is passed under the nozzle (310), the rate at which the solution (220) is sprayed on the base paper (130), the distance of the base paper (130) from the nozzle (310), the spraying profile of the nozzle (310), and the concentration of the multivalent salt solution (220), a layer of multivalent salt (110) with desired attributes may be deposited on the base paper (130).

Figure 4:
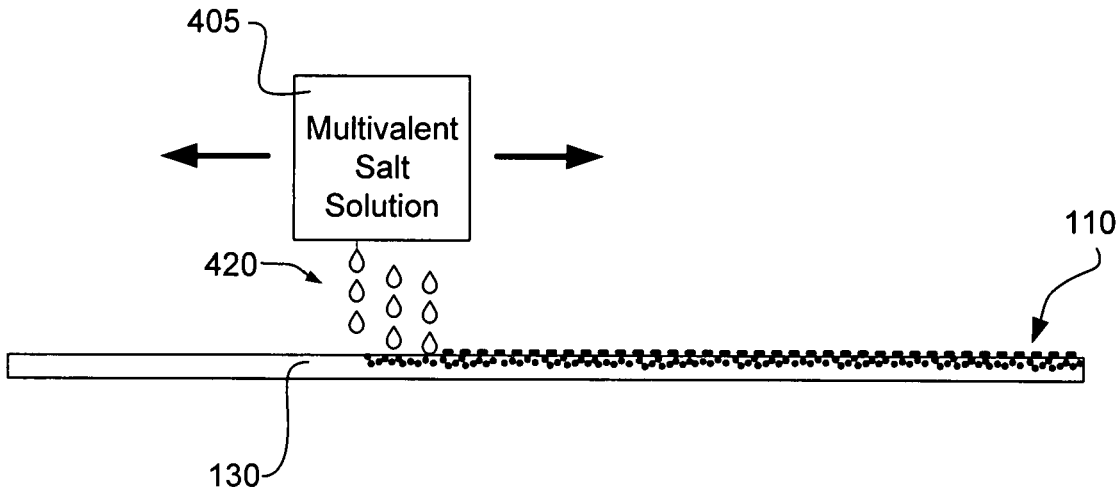
FIG. 4 is an illustration of an exemplary method of fabricating a newsprint medium for inkjet printing according to principles described herein.

Referring now to FIG. 4, another method of spray coating base paper (130) with a multivalent salt solution (420) to fabricate a newsprint medium suitable for inkjet printing is illustrated. The present method involves the use of an inkjet printing head (405) containing the multivalent salt solution. Similar to the way liquid ink is deposited on a substrate with a normal inkjet printer configuration, tiny droplets of the multivalent salt solution (420) are deposited by the inkjet printing head (405) onto the base paper (130) to form a layer of multivalent salt (110) on at least one side of the base paper (130).

The multivalent salt solution (420) may be deposited on the base paper (130) using either thermal inkjet technology or piezo inkjet technology. In some examples, it may be advantageous if the multivalent salt solution (420) solution is buffered. Where buffering of the solution is practiced, piezo inkjet technology may be especially beneficial as the quartz crystals used in dispensing the solution (420) using piezo inkjet technology are generally more corrosion-resistant than the thin films used in dispensing the solution (420) using thermal inkjet technology.

In some newsprint printing applications, relatively large areas of a sheet or piece of newsprint media (100; FIG. 1) may be left unprinted. In such applications, it may be desirable to conserve resources and only deposit multivalent salt solution in those areas of the newsprint media (100; FIG. 1) that will receive liquid ink. To address the issues of these and other situations, the controllable nature of inkjet deposition may be utilized to create a layer of multivalent salt (110) on the surface of base paper (130) in predetermined patterns.

It should be understood that different methods of coating the multivalent salt solution (420) on the base paper (130) provide different advantages, and different methods may be used according to the end requirements for the finished newsprint medium (100; FIG. 1). Traditional spray coating methods and inkjet spray coating methods have been described. Furthermore, it is also conceivable to use size press coating to deposit a layer of multivalent salt (110) on the surface of the base paper (130). This size press coating may be applied during the fabrication of the paper base (130).

Tradeoffs between the different coating methods described herein exist and may be considered as a user elects the best coating method for his or her specific application. An example of these tradeoffs is found in the fact that with inkjet technology the end result of multivalent salt solution deposition is generally more easily controlled than when using more traditional spray coating methods. Nevertheless, although traditional spray coating methods may be less controlled from a fluid application standpoint, they are generally quicker and more economical than inkjet methods.

Figure 5:
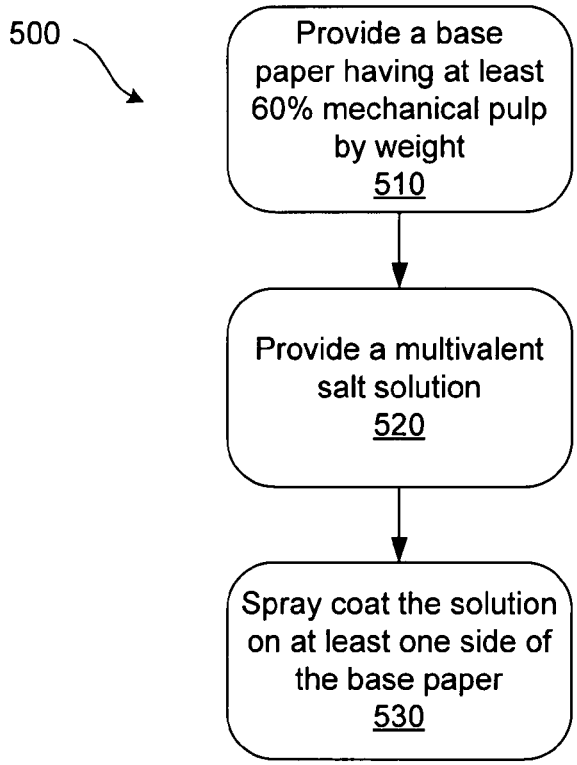
FIG. 5 is a flowchart illustrating an exemplary method of fabricating a newsprint medium for inkjet printing according to principles described herein.

Referring now to FIG. 5, a flowchart is shown illustrating an exemplary method (500) of fabricating a newsprint medium. The method (500) includes the steps of providing (step 510) a base paper having at least 60% mechanical pulp by weight and providing (step 520) a multivalent salt solution. The base paper may be untreated newsprint base paper such as is commercially available.

The multivalent salt solution may contain at least 3% of a multivalent salt. Examples of suitable multivalent salts for use in the multivalent salt solution include, but are not limited to, calcium chloride, magnesium chloride, calcium nitrate, aluminum chloride, sulfates of di- and trivalent metals, nitrates of di- and trivalent metals, and combinations thereof.

The multivalent salt solution is spray coated (step 530) on at least one side of the base paper. As previously discussed, the multivalent salt solution may be spray coated using traditional spray coating methods, inkjet methods or other methods. The method (500) may further comprise the step of spray coating the multivalent salt solution on a second side of the base paper to create a newsprint medium capable of receiving inkjet printed images and/or text on two sides.

Exemplary System

Newsprint media according to the principles disclosed herein may be used in conjunction with an inkjet printer to produce printed images and/or text having suitable color gamut, strikethrough, optical density, and dry time characteristics.

Figure 6:
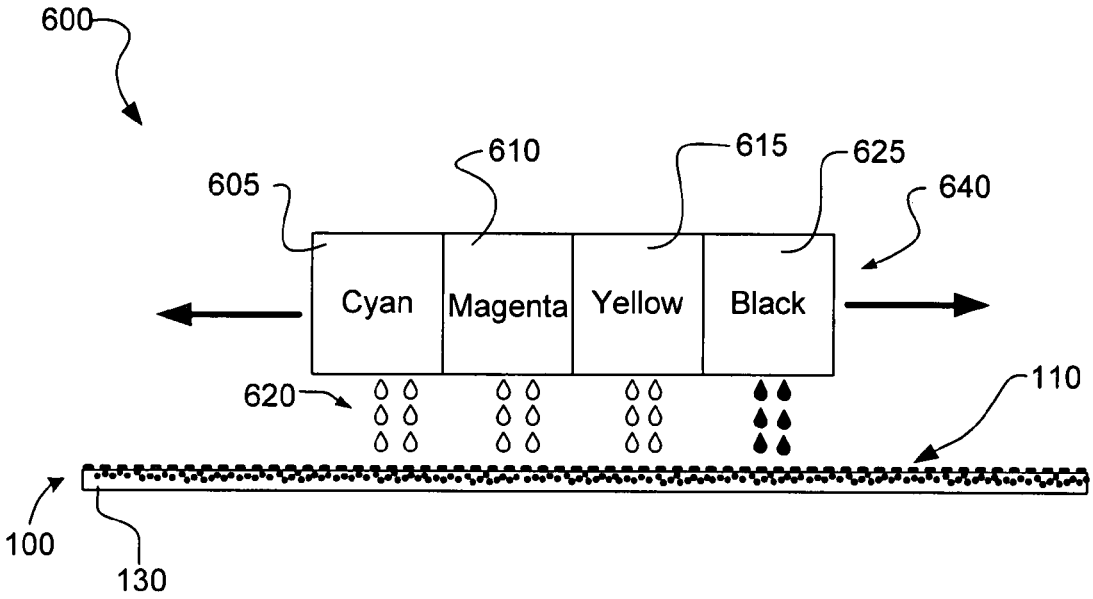
FIG. 6 is an illustration of an exemplary embodiment of a printing system according to principles described herein.

Referring now to FIG. 6, an exemplary printing system (600) according to principles described herein is shown. The printing system (600) comprises an inkjet printer (640) and a newsprint medium (100). The inkjet printer (640) of this embodiment comprises four print heads (605, 610, 615, 625), each print head containing cyan, magenta, yellow, and black ink, respectively. The print heads (605, 610, 615, 625) are configured to deposit droplets of liquid ink (620) on the newsprint medium (100) to form images and/or text. The differently colored inks may be combined to create composite colors and images.

In some embodiments, the newsprint medium (100) comprises a base paper (130) having at least 60% mechanical pulp by weight. At least one side of the base paper (130) has at least 0.2 gsm (grams per square meter) of a multivalent salt deposited thereon. Images produced by the inkjet printer (640) depositing ink on the medium exhibit at least a 10% increase in average optical density over images produced by depositing the ink on untreated newsprint media, such as untreated base paper (130). The multivalent salt (110) layer may bond chemically to the colorant(s) in the ink deposited on the newsprint medium (100) and keep the colorant particles at the surface of the newsprint medium (100). By increasing the amount of colorant particles remaining on the surface of the newsprint medium (100), fewer colorant particles are absorbed into the bulk of the newsprint medium (100), thus improving strikethrough, optical density, and color gamut characteristics of the printed image.

Many different colorants may be used to impart color to the inkjet inks, including pigments and dyes.

A pigment or any number of pigment blends may be provided in the inkjet ink formulation to impart color to the resulting ink. The pigment may be any number of desired pigments dispersed throughout the resulting inkjet ink. More particularly, the pigment included in the present inkjet ink may include, but is in no way limited to, self-dispersed (surface modified) pigments, or pigments accompanied by a dispersant.

Suitable pigments that may be included in the present inkjet ink can be black pigments, white pigments, cyan pigments, magenta pigments, yellow pigments, or the like. Further, pigments can be organic or inorganic particles as is well known in the art. Suitable inorganic pigments include, for example, carbon black. However, other inorganic pigments may be suitable such as titanium oxide, cobalt blue ($CoO—Al_2O_3$), chrome yellow ($PbCrO_4$), and iron oxide. Suitable organic pigments include, for example, azo pigments including diazo pigments and monoazo pigments, polycyclic pigments (e.g., phthalocyanine pigments such as phthalocyanine blues and phthalocyanine greens, perylene pigments, perynone pigments, anthraquinone pigments, quinacridone pigments, dioxazine pigments, thioindigo pigments, isoindolinone pigments, pyranthrone pigments, and quinophthalone pigments), insoluble dye chelates (e.g., basic dye type chelates and acidic dye type chelate), nitropigments, nitroso pigments, anthanthrone pigments such as PR168, and the like. Representative examples of phthalocyanine blues and greens include copper phthalocyanine blue, copper phthalocyanine green and derivatives thereof (Pigment Blue 15 and Pigment Green 36). Representative examples of quinacridones include Pigment Orange 48, Pigment Orange 49, Pigment Red 122, Pigment Red 192, Pigment Red 202, Pigment Red 206, Pigment Red 207, Pigment Red 209, Pigment Violet 19 and Pigment Violet 42. Representative examples of anthraquinones include Pigment Red 43, Pigment Red 194 (Perinone Red), Pigment Red 177, Pigment Red 216 (Brominated Pyranthrone Red) and Pigment Red 226 (Pyranthrone Red). Representative examples of perylenes include Pigment Red 123 (Vermillion), Pigment Red 149 (Scarlet), Pigment Red 179 (Maroon), Pigment Red 190 (Red), Pigment Red 189 (Yellow Shade Red) and Pigment Red 224. Representative examples of thioindigoids include Pigment Red 86, Pigment Red 87, Pigment Red 88, Pigment Red 181, Pigment Red 198, Pigment Violet 36, and Pigment Violet 38. Representative examples of heterocyclic yellows include Pigment Yellow 1, Pigment Yellow 3, Pigment Yellow 12, Pigment Yellow 13, Pigment Yellow 14, Pigment Yellow 17, Pigment Yellow 65, Pigment Yellow 73, Pigment Yellow 74, Pigment Yellow 90, Pigment Yellow 110, Pigment Yellow 117, Pigment Yellow 120, Pigment Yellow 128, Pigment Yellow 138, Pigment Yellow 150, Pigment Yellow 151, Pigment Yellow 155, and Pigment Yellow 213. Such pigments are commercially available in either powder or press cake form from a number of sources including, BASF Corporation, Engelhard Corporation and Sun Chemical Corporation.

Examples of black pigments that can be used include carbon pigments. The carbon pigment can be almost any commercially available carbon pigment that provides acceptable optical density and print characteristics. Carbon pigments suitable for use in the present system and method include, without limitation, carbon black, graphite, vitreous carbon, charcoal, and combinations thereof. Such carbon pigments can be manufactured by a variety of known methods such as a channel method, a contact method, a furnace method, an acetylene method, or a thermal method, and are commercially available from such vendors as Cabot Corporation, Columbian Chemicals Company, Degussa AG, and E.I. DuPont de Nemours and Company. Suitable carbon black pigments include, but are not limited to, Cabot pigments such as MONARCH 1400, MONARCH 1300, MONARCH 1100, MONARCH 1000, MONARCH 900, MONARCH 880, MONARCH 800, MONARCH 700, CAB-O-JET 200, CAB-O-JET 300, REGAL, BLACK PEARLS, ELFTEX, MOGUL, and VULCAN pigments; Columbian pigments such as RAVEN 7000, RAVEN 5750, RAVEN 5250, RAVEN 5000, and RAVEN 3500; Degussa pigments such as Color Black FW 200, RAVEN FW 2, RAVEN FW 2V, RAVEN FW 1, RAVEN FW 18, RAVEN S160, RAVEN FW S170, Special Black 6, Special Black 5, Special Black 4A, Special Black 4, PRINTEX U, PRINTEX 140U, PRINTEX V, and PRINTEX 140V; and TIPURE R-101 available from Dupont. The above list of pigments includes unmodified pigment particulates, small molecule attached pigment particulates, and polymer-dispersed pigment particulates.

Similarly, a wide variety of colored pigments can be used with the present system and method. Therefore, the following listing is not intended to be exclusive. For example, colored pigments can be blue, brown, cyan, green, white, violet, magenta, red, orange, yellow, as well as mixtures thereof. The following color pigments are available from Cabot Corp.: CABO-JET 250C, CABO-JET 260M, and CABO-JET 270Y. The following color pigments are available from BASF Corp.: PALIOGEN Orange, PALIOGEN Orange 3040, PALIOGEN Blue L 6470, PALIOGEN Violet 5100, PALIOGEN Violet 5890, PALIOGEN Yellow 1520, PALIOGEN Yellow 1560, PALIOGEN Red 3871K, PALIOGEN Red 3340, HELIOGEN Blue L 6901F, HELIOGEN Blue NBD 7010, HELIOGEN Blue K 7090, HELIOGEN Blue L 7101F, HELIOGEN Blue L6900, L7020, HELIOGEN Blue D6840, HELIOGEN Blue D7080, HELIOGEN Green L8730, HELIOGEN Green K 8683, and HELIOGEN Green L 9140. The following pigments are available from Ciba-Geigy Corp.: CHROMOPHTAL Yellow 3G, CHROMOPHTAL Yellow GR, CHROMOPHTAL Yellow 8G, IGRAZIN Yellow 5GT, IGRALITE Rubine 4BL, IGRALITE Blue BCA, MONASTRAL Magenta, MONASTRAL Scarlet, MONASTRAL Violet R, MONASTRAL Red B, and MONASTRAL Violet Maroon B. The following pigments are available from Heubach Group: DALAMAR Yellow YT-858-D and HEUCOPHTHAL Blue G XBT-583D. The following pigments are available from Hoechst Specialty Chemicals: Permanent Yellow GR, Permanent Yellow G, Permanent Yellow DHG, Permanent Yellow NCG-71, Permanent Yellow GG, Hansa Yellow RA, Hansa Brilliant Yellow 5GX-02, Hansa Yellow-X, NOVOPERM Yellow HR, NOVOPERM Yellow FGL, Hansa Brilliant Yellow 10GX, Permanent Yellow G3R-01, HOSTAPERM Yellow H4G, HOSTAPERM Yellow H3G, HOSTAPERM Orange GR, HOSTAPERM Scarlet GO, HOSTAPERM Pink E, Permanent Rubine F6B, and the HOSTAFINE series. The following pigments are available from Mobay Corp.: QUINDO Magenta, INDOFAST Brilliant Scarlet, QUINDO Red R6700, QUINDO Red R6713, and INDOFAST Violet. The following pigments are available from Sun Chemical Corp.: L74-1357 Yellow, L75-1331 Yellow, and L75-2577 Yellow. Other examples of pigments can include Normandy Magenta RD-2400, Permanent Violet VT2645, Argyle Green XP-111-S, Brilliant Green Toner GR 0991, Sudan Blue OS, PV Fast Blue B2GO1, Sudan III, Sudan II, Sudan IV, Sudan Orange G, Sudan Orange 220, Ortho Orange OR 2673, Lithol Fast Yellow 0991K, Paliotol Yellow 1840, Lumogen Yellow D0790, Suco-Gelb L1250, Suco-Yellow D1355, Fanal Pink D4830, Cinquasia Magenta, Lithol Scarlet D3700, Toluidine Red, Scarlet for Thermoplast NSD PS PA, E. D. Toluidine Red, Lithol Rubine Toner, Lithol Scarlet 4440, Bon Red C, Royal Brilliant Red RD-8192, Oracet Pink RF, and Lithol Fast Scarlet L4300. These pigments are available from commercial sources such as Hoechst Celanese Corporation, Paul Uhlich, BASF, American Hoechst, Ciba-Geigy, Aldrich, DuPont, Ugine Kuhlman of Canada, Dominion Color Company, Magruder, and Matheson. Examples of other suitable colored pigments are described in the Colour Index, 3rd edition (The Society of Dyers and Colourists, 1982).

The above-illustrated pigments can be used singly or in a combination of two or more. Typically, the pigments of the present system and method can be from about 10 nm to about 10 μm and in one aspect can be from 10 nm to about 500 nm in diameter, although sizes outside this range can be used if the pigment can remain dispersed and provide adequate color properties. In one detailed aspect of the present system and method, the pigment can comprise from about 1% to about 20% by weight of the inkjet ink composition, and often can comprise from about 2% to about 6% by weight of the inkjet ink composition.

As mentioned previously, the colorants of the present exemplary system and method can further include a dispersant attached thereto. In one specific embodiment, the dispersant can include, but is in no way limited to, a carboxylic acid group, however, reactive groups such as alcohol, amine, anhydride, sulfonic acid, thiol, halotriazine, maleimide and vinyl sulfone, or the like can also be used. A wide variety of dispersants are known to those skilled in the art. Non-limiting examples broad classes of suitable dispersants include polyalkyl glycols, polyalkyl imines, aryl dicarboxylic acids such as phthalic acids, isophthalic acids, terephthalic acids, carbohydrates, acrylates, methacrylates, trehalose, isomers thereof, and combinations thereof.

As a general matter, glycol dispersants tend to be stable at neutral and higher pH, while imine dispersants tend to be stable at lower pH, e.g., about 4-6. In one specific embodiment, the dispersant can be polyethylene glycol. Dispersants can help to improve dispersion stability, but also can improve bleed control. Non-limiting examples of several specific suitable dispersants include polypropylene glycol, polyethylene imine, polyethylene glycol, trehalose, and combinations thereof. In some embodiments, the pigment may also have a polymer coupled thereto, the polymer being additionally coupled to a dispersant, such that the pigment is polymer-dispersed.

According to an alternative embodiment, a dye may be provided in the inkjet ink formulation in place of, or in addition to, the above-mentioned pigment, to impart color to the resulting ink. According to this exemplary embodiment, appropriate dye-based inks include, but are in no way limited to, anionic dye-based inks having water-soluble acid and direct dyes. Furthermore, one or more of these dyes may comprise a carboxylic acid group.

Though any effective amount of dye can be used in the present inkjet ink formulation, the inkjet ink can comprise from approximately 0.1 wt % to 10 wt % of the dye. Examples of suitable anionic dyes include a large number of water-soluble acid and direct dyes. Specific examples of anionic dyes include the Pro-Jet series of dyes available from Avecia Ltd., including Pro-Jet Yellow I (Direct Yellow 86), Pro-Jet Magenta I (Acid Red 249), Pro-Jet Cyan I (Direct Blue 199), Pro-Jet Black I (Direct Black 168), and Pro-Jet Yellow 1-G (Direct Yellow 132); Aminyl Brilliant Red F-B (Sumitomo Chemical Co.); the Duasyn line of "salt-free" dyes available from Hoechst, such as Duasyn Direct Black HEF-SF (Direct Black 168), Duasyn Black RL-SF (Reactive Black 31), Duasyn Direct Yellow 6G-SF VP216 (Direct Yellow 157), Duasyn Brilliant Yellow GL-SF VP220 (Reactive Yellow 37), Duasyn Acid Yellow XX-SF VP413 (Acid Yellow 23), Duasyn Brilliant Red F3B-SF VP218 (Reactive Red 180), Duasyn Rhodamine B-SF VP353 (Acid Red 52), Duasyn Direct Turquoise Blue FRL-SF VP368 (Direct Blue 199), and Duasyn Acid Blue AE-SF VP344 (Acid Blue 9); mixtures thereof; and the like. Further examples include Tricon Acid Red 52, Tricon Direct Red 227, and Tricon Acid Yellow 17 (Tricon Colors Incorporated), Bernacid Red 2BMN, Pontamine Brilliant Bond Blue A, BASF X-34, Pontamine, Food Black 2, Catodirect Turquoise FBL Supra Conc. (Direct Blue 199, Carolina Color and Chemical), Special Fast Turquoise 8GL Liquid (Direct Blue 86, Mobay Chemical), Intrabond Liquid Turquoise GLL (Direct Blue 86, Crompton and Knowles), Cibracron Brilliant Red 38-A (Reactive Red 4, Aldrich Chemical), Drimarene Brilliant Red X-2B (Reactive Red 56, Pylam, Inc.), Levafix Brilliant Red E-4B (Mobay Chemical), Levafix Brilliant Red E-6BA (Mobay Chemical), Pylam Certified D&C Red #28 (Acid Red 92, Pylam), Direct Brill Pink B Ground Crude (Crompton & Knowles), Cartasol Yellow GTF Presscake (Sandoz, Inc.), Tartrazine Extra Conc. (FD&C Yellow #5, Acid Yellow 23, Sandoz, Inc.), Catodirect Yellow RL (Direct Yellow 86, Carolina Color and Chemical), Cartasol Yellow GTF Liquid Special 110 (Sandoz, Inc.), D&C Yellow #10 (Yellow 3, Tricon), Yellow Shade 16948 (Tricon), Basacid Black X34 (BASF), Carta Black 2GT (Sandoz, Inc.), Neozapon Red 492 (BASF), Orasol Red G (Ciba-Geigy), Direct Brilliant Pink B (Crompton-Knolls), Aizen Spilon Red C-BH (Hodagaya Chemical Company), Kayanol Red 3BL (Nippon Kayaku Company), Levanol Brilliant Red 3BW (Mobay Chemical Company), Levaderm Lemon Yellow (Mobay Chemical Company), Aizen Spilon Yellow C-GNH (Hodagaya Chemical Company), Spirit Fast Yellow 3G, Sirius Supra Yellow GD 167, Cartasol Brilliant Yellow 4GF (Sandoz), Pergasol Yellow CGP (Ciba-Geigy), Orasol Black RL (Ciba-Geigy), Orasol Black RLP (Ciba-Geigy), Savinyl Black RLS (Sandoz), Dermacarbon 2GT (Sandoz), Pyrazol Black BG (ICI Americas), Morfast Black Conc A (Morton-Thiokol), Diazol Black RN Quad (ICI Americas), Orasol Blue GN (Ciba-Geigy), Savinyl Blue GLS (Sandoz, Inc.), Luxol Blue MBSN (Morton-Thiokol), Sevron Blue 5GMF (ICI Americas), and Basacid Blue 750 (BASF); Levafix Brilliant Yellow E-GA, Levafix Yellow E2RA, Levafix Black EB, Levafix Black E-2G, Levafix Black P-36A, Levafix Black PN-L, Levafix Brilliant Red E6BA, and Levafix Brilliant Blue EFFA, all available from Bayer; Procion Turquoise PA, Procion Turquoise HA, Procion Turquoise Ho5G, Procion Turquoise H-7G, Procion Red MX-5B, Procion Red H8B (Reactive Red 31), Procion Red MX 8B GNS, Procion Red G, Procion Yellow MX-8G, Procion Black H-EXL, Procion Black P-N, Procion Blue MX-R, Procion Blue MX-4GD, Procion Blue MX-G, and Procion Blue MX-2GN, all available from ICI Americas; Cibacron Red F-B, Cibacron Black BG, Lanasol Black B, Lanasol Red 5B, Lanasol Red B, and Lanasol Yellow 46, all available from Ciba-Geigy; Baslien Black P-BR, Baslien Yellow EG, Baslien Brilliant Yellow P-3GN, Baslien Yellow M-6GD, Baslien Brilliant Red P-3B, Baslien Scarlet E-2G, Baslien Red E-B, Baslien Red E-7B, Baslien Red M-5B, Baslien Blue E-R, Baslien Brilliant Blue P-3R, Baslien Black P-BR, Baslien Turquoise Blue P-GR, Baslien Turquoise M-2G, Baslien Turquoise E-G, and Baslien Green E-6B, all available from BASF; Sumifix Turquoise Blue G, Sumifix Turquoise Blue H-GF, Sumifix Black B, Sumifix Black H-BG, Sumifix Yellow 2GC, Sumifix Supra Scarlet 2GF, and Sumifix Brilliant Red 5BF, all available from Sumitomo Chemical Company; Intracron Yellow C-8G, Intracron Red C-8B, Intracron Turquoise Blue GE, Intracron Turquoise HA, and Intracron Black RL, all available from Crompton and Knowles, Dyes and Chemicals Division; Pro-Jet 485 (a copper phthalocyanine); Magenta 377; mixtures thereof; and the like. This list is intended to be merely exemplary, and should not be considered limiting or exclusive.

EXAMPLES

The following examples illustrate a number of embodiments of the present systems and methods. However, it is to be understood that the following are only exemplary or illustrative of the application of the principles of the present systems and methods. Numerous modifications and alternative compositions, methods, and systems may be devised by those skilled in the art without departing from the spirit and scope of the present systems and methods. The appended claims are intended to cover such modifications and arrangements. Thus, while the present systems and methods have been described above with particularity, the following examples provide further details.

Example 1

According to principles described herein, porous media were coated with the multivalent salt calcium chloride ($CaCl_2$) in varying quantities. The quantities of calcium chloride present on the media ranged from an untreated control set to 1.5 grams/square meter (gsm). Liquid inks were then loaded into thermal inkjet pens and identical images were printed on the media.

Figure 7:
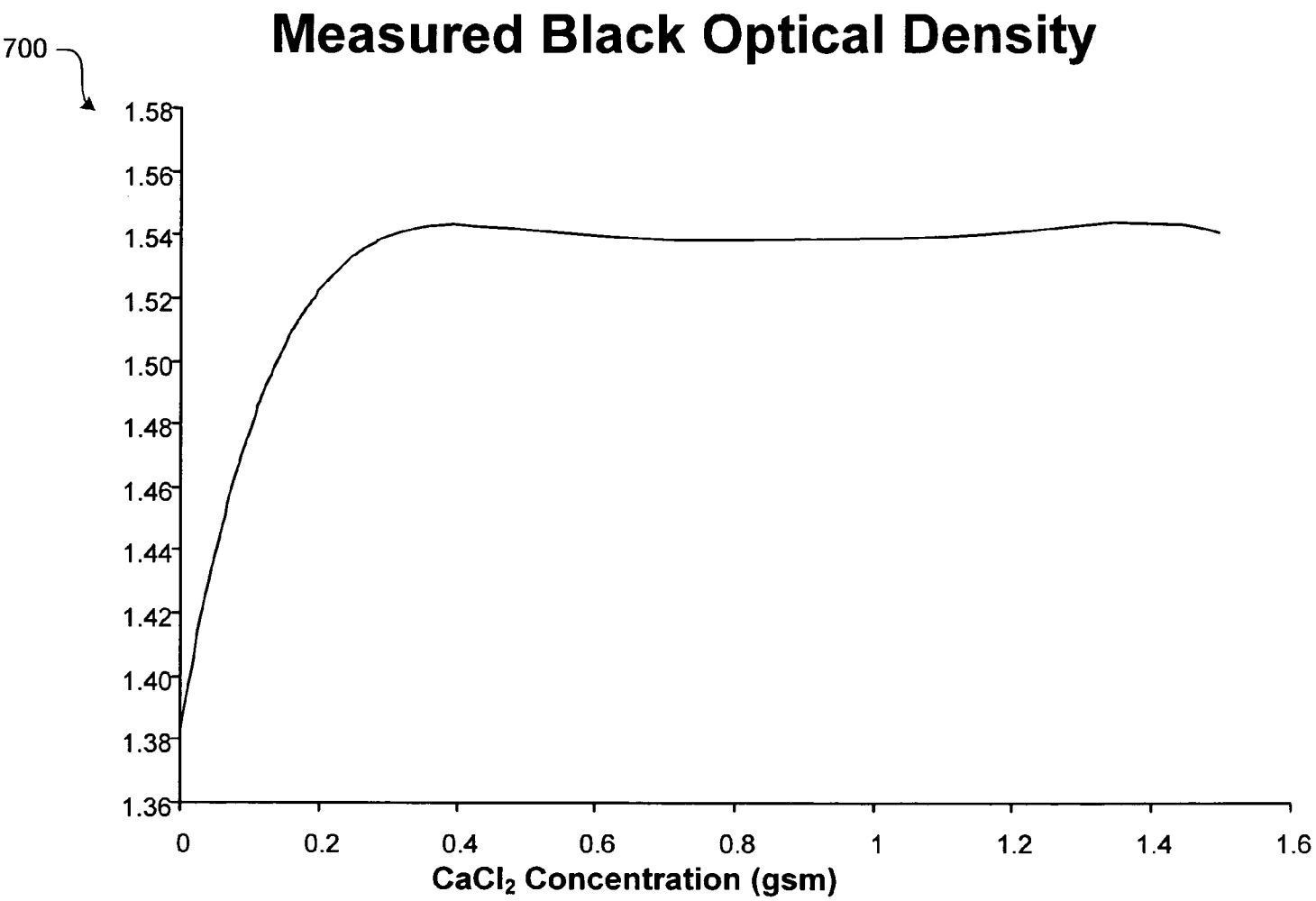
FIG. 7 illustrates exemplary data obtained according to principles described herein.

Referring now to FIG. 7, measured black optical density data (700) from this example are represented in a graph. As shown on the graph, the untreated media had a measured black optical density of about 1.39. However, in media treated with as little as 0.25 gsm of calcium chloride an optical density of approximately 1.55 was measured. The optical density improvement of the image printed on the treated media exhibited a marked improvement of approximately 11.5%.

Figure 8:
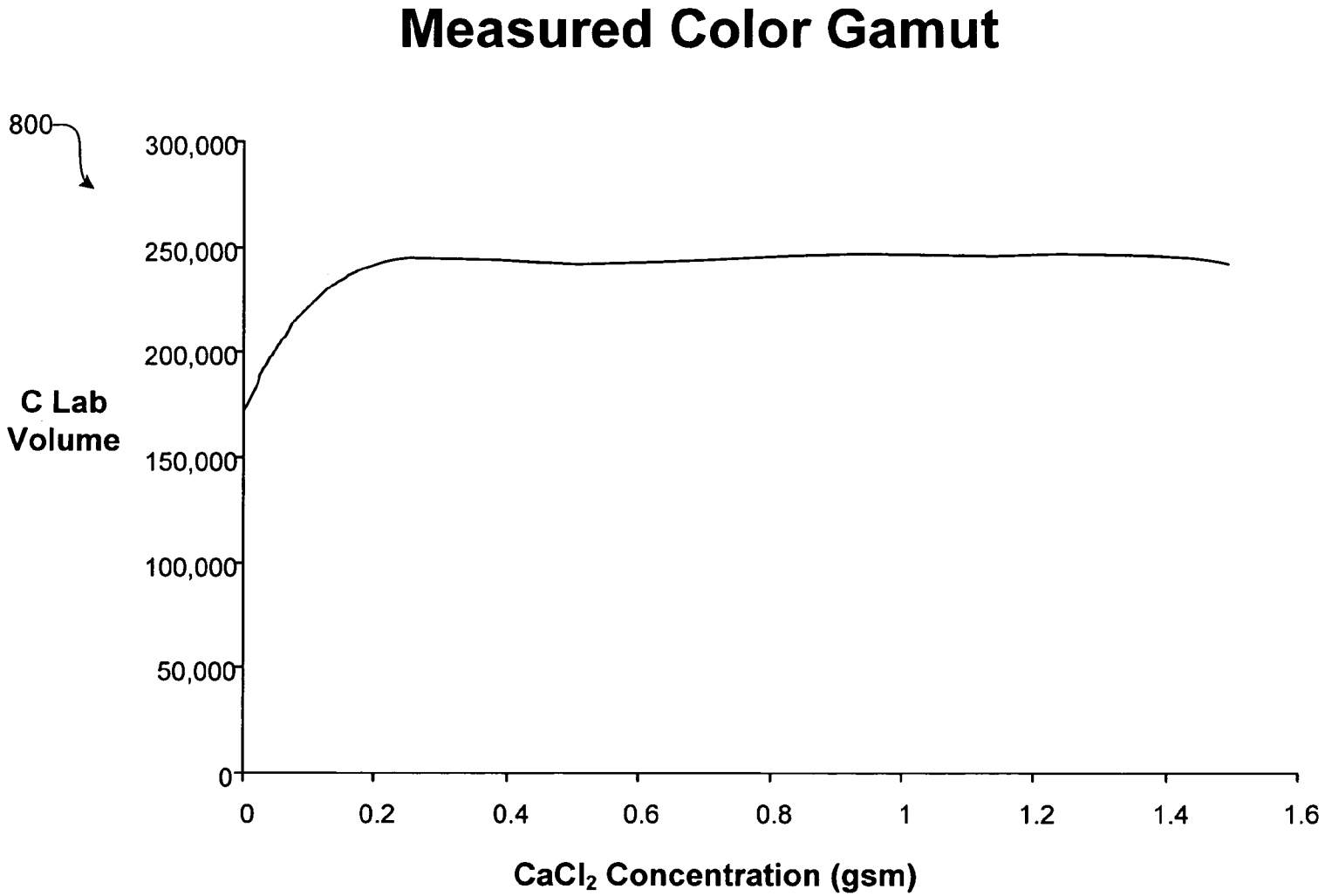
FIG. 8 illustrates exemplary data obtained according to principles described herein.

Referring now to FIG. 8, identical color images were printed on the media and color gamut data (800) from the images were measured. The data were measured in CIELab volume units and are based on eight color squares (cyan, magenta, yellow, black, red, green, blue, white). These data (800) are represented on the graph shown. As can be seen on the graph, the untreated media exhibited a measured color gamut of approximately 170,000. Media coated with 0.1 gsm of calcium chloride exhibited an increase of approximately 55,000 (32.4%) and media treated with about 0.25 gsm of calcium chloride exhibited a marked increase of 75,000 (44%).

Figure 9:
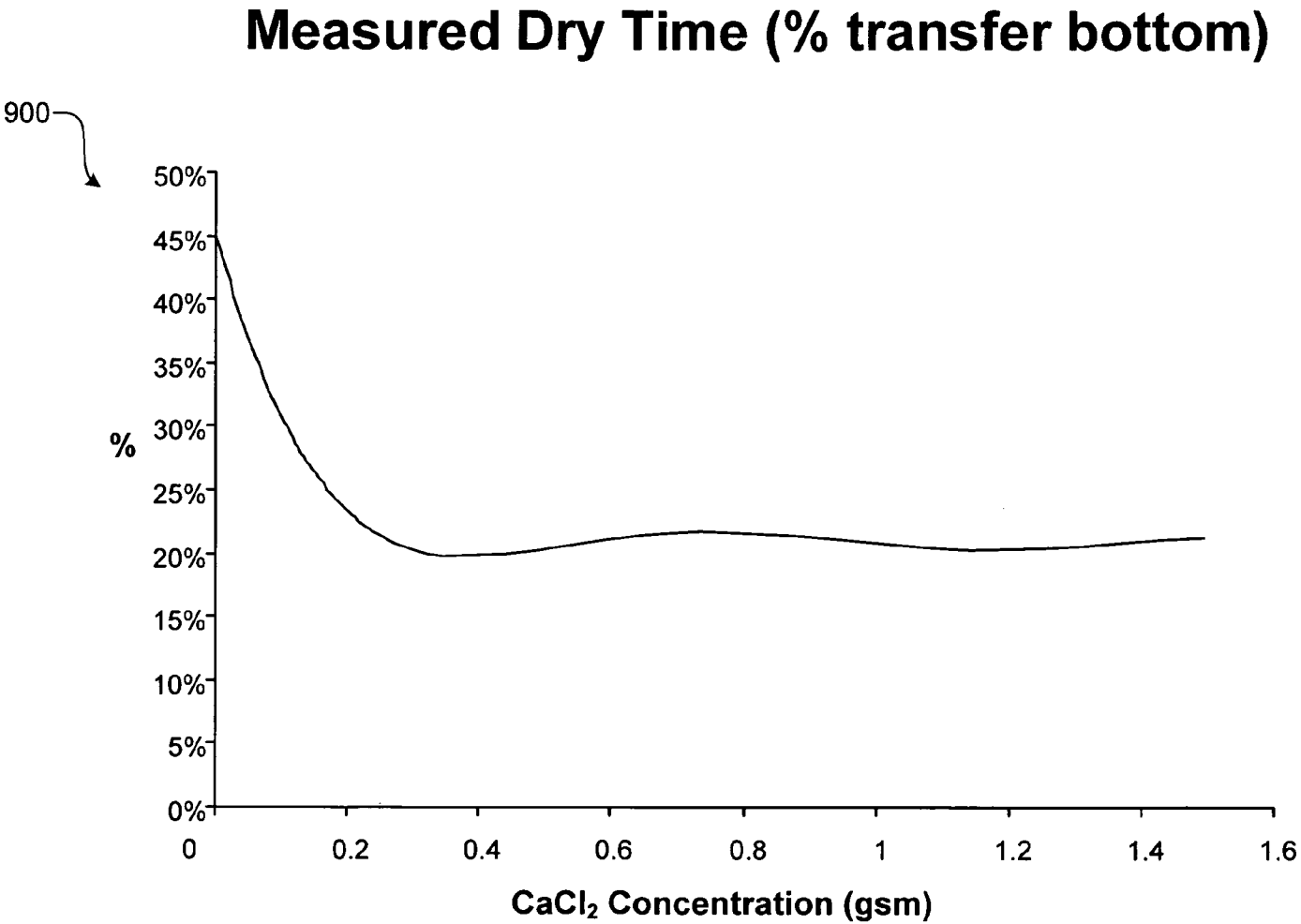
FIG. 9 illustrates exemplary data obtained according to principles described herein.

Referring now to FIG. 9, dry time data (900) were also measured from the media using what is known as the percentage transfer bottom method. The percentage transfer bottom method involves printing 100% black squares on the media and waiting a controlled amount of time before placing a blank piece of paper over the black squares. Then a rubber roller was rolled over the image, the pressure of the roller remaining constant. Depending on how much the ink had dried on the media, a quantity of the ink would transfer from the media to the blank piece of paper, measured as a percentage of the original quantity of ink printed. This quantity is referred to as the percentage transfer.

Due to the difficulty in directly measuring the percentage transfer, it was measured indirectly from the black optical density measurement of the ink that was transferred to the blank piece of paper. A percentage transfer measurement was then extrapolated from the black optical density measurement of the ink on the blank piece of paper.

As shown on the graph, the percentage of ink transferred to the blank sheet of paper from the control media was approximately 40% after a controlled passage of time. However with a coating of about 0.4 gsm of calcium chloride on the media, the percentage of ink transferred to the blank sheet was reduced to about 20%. This reduction in ink transfer correlates to a decreased dry time in the media coated with multivalent salt.

Example 2

According to the principles described herein, porous media were coated with a 5% solution of the multivalent salt calcium chloride. Two different ink sets, identified as ink set #1 and ink set #2 were used to print identical images on control media without the multivalent salt additive and on the media coated with the calcium chloride. Color gamut and black optical density measurements were then made of the printed images.

Figure 10:
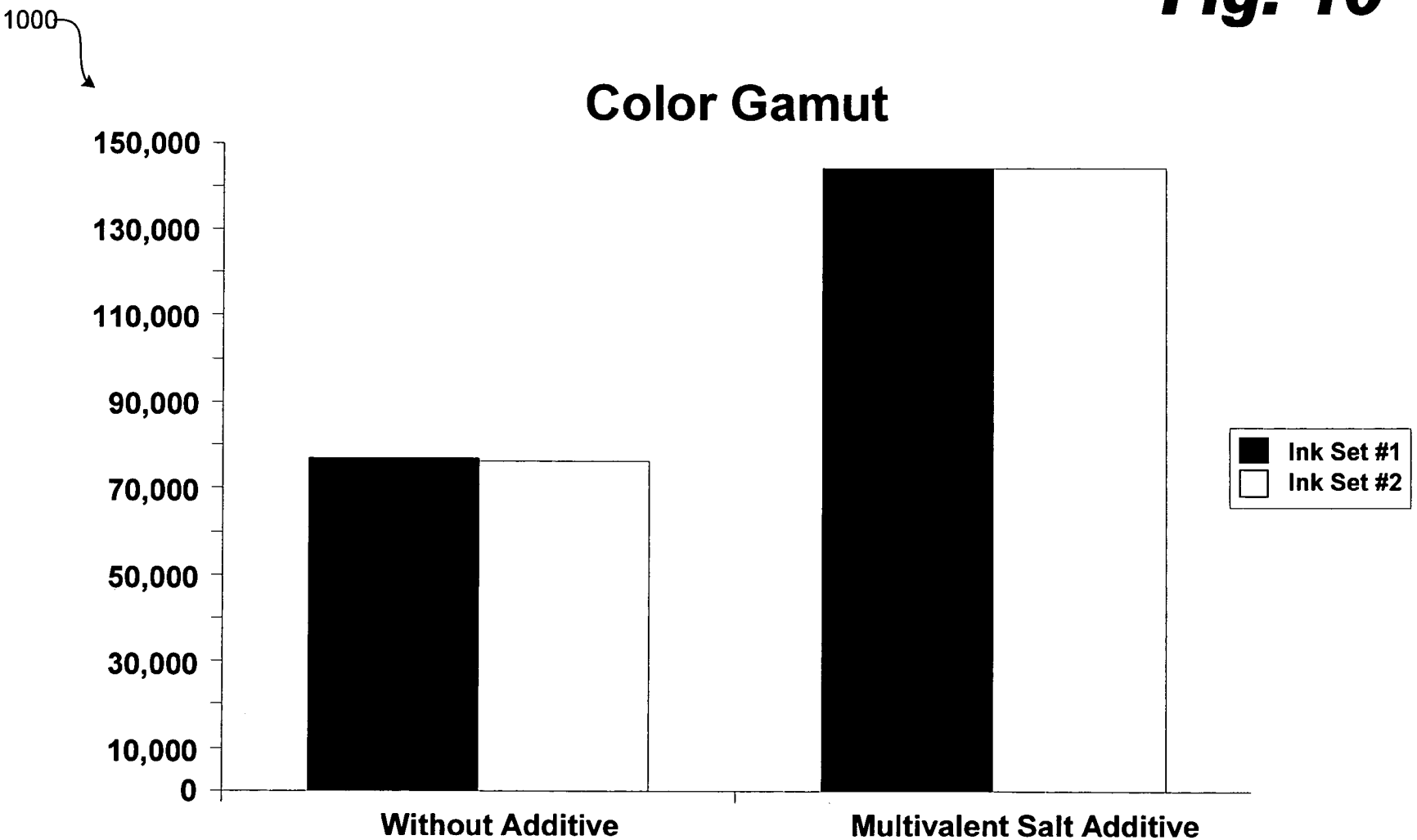
FIG. 10 illustrates exemplary data obtained according to principles described herein.

Referring now to FIG. 10, the color gamut data (1000) are shown in a graph comparing the control media to the media treated with calcium chloride. As seen in the graph, in both ink sets a color gamut increase of approximately 50% was exhibited in the treated media over the control media.

Figure 11:
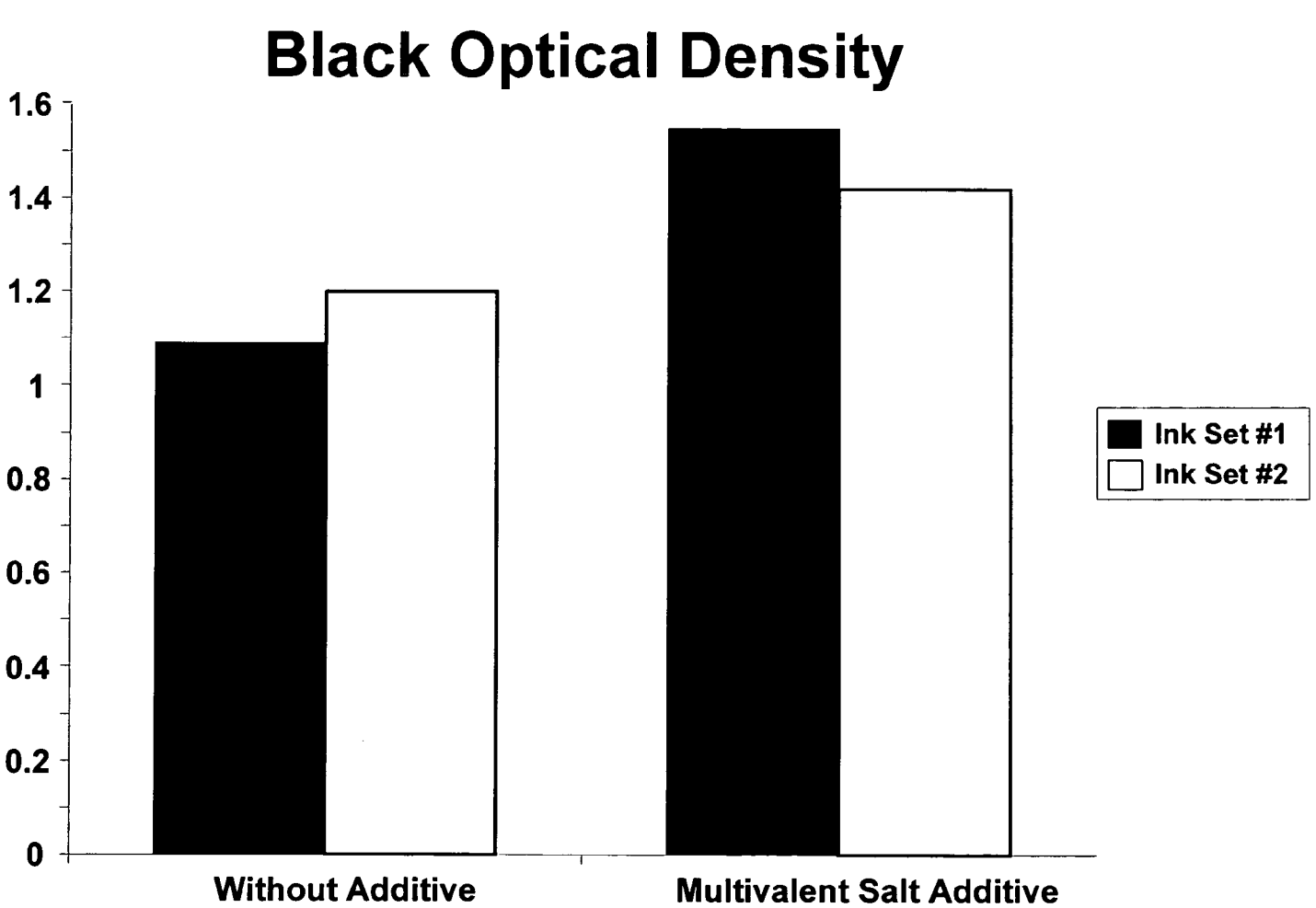
FIG. 11 illustrates exemplary data obtained according to principles described herein.

Referring now to FIG. 11, the black optical density data (1100) are shown in a graph comparing the control media to the media treated with calcium chloride. According to the measured data (1100) ink set #1 exhibited an increase in black optical density of approximately 41% in the treated media over the control media. Likewise, ink set #2 exhibited an increase of approximately 17.2% in black optical density in the treated media compared to the control media.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A newsprint medium for inkjet printing, comprising:

a newsprint medium base paper; and a layer of multivalent salt disposed on at least one side of said base paper;

wherein said multivalent salt is selected from the group consisting of calcium chloride, calcium nitrate, aluminum chloride, nitrates of di- and trivalent metals, and combinations thereof.

2. The newsprint medium of claim 1, wherein said multivalent salt further comprises: magnesium chloride, sulfates of di- and trivalent metals, and combinations thereof.

3. The newsprint medium of claim 1, wherein said base paper is at least 60% mechanical pulp by weight.

4. The newsprint medium of claim 1, wherein said a layer of multivalent salt is disposed on both sides of said base paper.

5. The newsprint medium of claim 1, wherein said multivalent salt is applied in a predetermined pattern on said base paper.

6. The newsprint medium of claim 5, wherein said pattern corresponds to only those portions of said newsprint medium that will receive ink during printing.

7. The newsprint medium of claim 1, wherein said multivalent salt is applied uniformly to at least one side of said base paper.

8. The newsprint medium of claim 1, wherein said multivalent salt is disposed on said base paper in an amount of at least 0.2 gsm.

9. A method of fabricating a newsprint medium, comprising:

providing a newsprint medium base paper;

providing a multivalent salt solution of claim 1; and applying said solution on at least one side of said base paper.

10. A newsprint medium for inkjet printing, comprising:

a newsprint base paper at least 60% mechanical pulp by weight; and a first layer of calcium chloride disposed on at least one side of the base paper.

11. The newsprint medium of claim 10, in which the calcium chloride is disposed uniformly on a first side of the base paper and is distributed through the base paper to form a second layer of calcium chloride on a second side of the base paper, such that the layer of calcium chloride disposed on the first side of the base paper in an amount of at least 0.20 gsm and the layer of calcium chloride disposed on the second side of the base paper in an amount of at least 0.20 gsm.

12. The newsprint medium of claim 10, in which the first layer of calcium chloride is disposed on the base paper in a predetermined pattern which corresponds to only those portions of the newsprint medium that will receive ink during printing.

13. The newsprint medium of claim 10, wherein the layer of calcium chloride is disposed on both sides of the base paper.

14. The newsprint medium of claim 10, in which the layer calcium chloride further comprises a buffer.

15. The newsprint medium of claim 10, in which the layer of calcium chloride is disposed on the base paper in an amount greater than 3.0 gsm.

16. The newsprint medium of claim 1, in which said layer of multivalent salt is disposed uniformly on a first side of said base paper and is distributed through said base paper to form a second layer of multivalent salt on a second side of said base paper, such that said layer of multivalent salt disposed on said first side of said base paper in an amount of at least 0.20 gsm and said second layer of multivalent salt disposed on said second side of said base paper in an amount of at least 0.20 gsm.

17. The newsprint medium of claim 1, in which said layer of multivalent salt does not comprise a buffer.

18. The newsprint medium of claim 1, in which said layer of multivalent salt is disposed on said base paper in an amount greater than 3.0 gsm.

19. A newsprint medium for inkjet printing, comprising:

a newsprint base paper at least 60% mechanical pulp by weight; and a first layer of calcium chloride disposed on first side of the base paper in an amount of at least 0.20 gsm and a second layer of calcium chloride disposed on the second side of the base paper in an amount of at least 0.20 gsm;

in which the first layer of calcium chloride is disposed in a pattern which corresponds to only those portions of the first side of the base paper that will receive ink during printing and the second layer of calcium chloride is disposed in a pattern which corresponds to only those portions of the second of the base paper that will receive ink during printing.

* * * * *